United States Patent [19]

Waters

[11] Patent Number: 4,512,686

[45] Date of Patent: Apr. 23, 1985

[54] ROOF SUPPORT SUITABLE FOR USE IN MINES

[75] Inventor: John H. Waters, Cheltenham, England

[73] Assignee: Dowty Mining Equipment Limited, England

[21] Appl. No.: 593,818

[22] Filed: Mar. 27, 1984

[30] Foreign Application Priority Data

Apr. 16, 1983 [GB] United Kingdom ..... 8310348

[51] Int. Cl.[3] ..... E21D 15/44; E21D 17/054

[52] U.S. Cl. ..... 405/293

[58] Field of Search ..... 405/290, 291, 293, 294, 405/295; 299/33

[56] References Cited

U.S. PATENT DOCUMENTS 3,534,559 10/1970 Seddon et al. ..... 405/294

FOREIGN PATENT DOCUMENTS 1037734 8/1966 United Kingdom .
1139870 1/1969 United Kingdom .
1236833 6/1971 United Kingdom .
1562845 3/1980 United Kingdom .
840392 6/1981 U.S.S.R. ..... 405/293

*Primary Examiner*—David H. Corbin
*Attorney, Agent, or Firm*—Hayes, Davis & Soloway

[57] ABSTRACT

A roof support, suitable for use in mines, includes a roof-engageable canopy comprising a main portion and an extension portion pivotally-connected to the main portion. Actuator means is carried by the main portion and arranged to effect sliding movement of a wedge member. This member has a wedging face which is co-operable with a complementary face formed on a part of the extension portion which projects substantially beyond the pivotal connection of the extension portion to the main portion and in the direction towards the actuator means. The sliding movement of the wedge member effects tilting of the extension portion with respect to the main portion.

9 Claims, 5 Drawing Figures

ROOF SUPPORT SUITABLE FOR USE IN MINES

Figure 1:
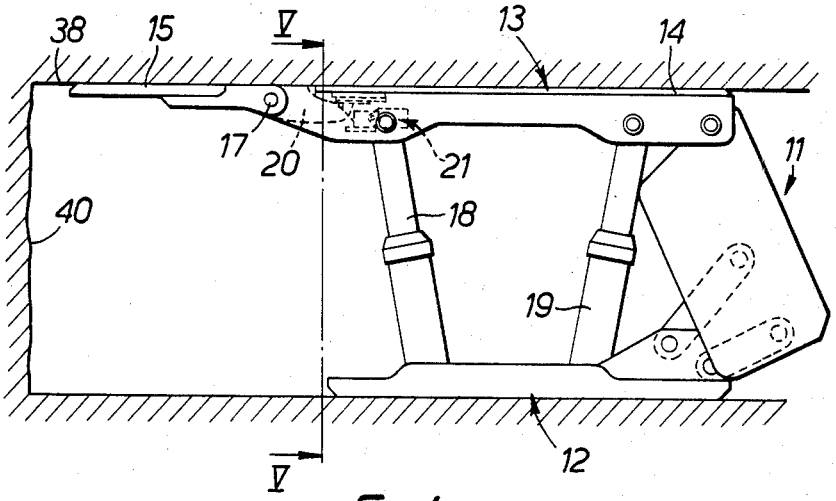

This invention relates to roof supports suitable for use in mines for supporting the mine roof during mineral mining operations.

Such a roof support, which can be of self-advancing type, includes a floor-engaging structure, extendible and contractible prop means carried by said structure, and a roof-engageable canopy supported by the prop means.

In certain cases the canopy may have an extension portion, suitably hinged to the main portion thereof, which can be tilted upwardly against the mine roof for positive load-supporting engagement when necessary with any cavities which may be present in the roof surface and/or against any divergence in that surface adjacent the working face of the mine. The tilting has often hitherto been effected by actuator means which was operable in conjunction with a pivotal driving linkage, such linkage usually having been of such form, and the actuator means disposed in such an attitude, as to take up considerable valuable space on the underside of the canopy. Such arrangements have been undesirable because the available space for access and for the passage of associated equipment, for example cutting machines, is limited, this being particularly disadvantageous in those roof supports intended for use in mines having relatively thin mineral seams.

The invention as claimed is intended to provide a remedy. It solves the problem of how to design an improved roof support intended to overcome the above-mentioned problem.

According to this invention a roof support, suitable for use in mines, includes a floor-engaging structure, extendible and contractible prop means carried by said structure, a roof-engageable canopy, supported by said prop means, which comprises a main portion and an extension portion pivotally-connected to the main portion, actuator means carried by said main portion, and a wedge member so carried by said main portion and so connected with the output member of said actuator means as to be slidable, upon operation of said actuator means, lengthwise of said main portion, the end portion of said wedge member remote from said actuator means having a wedging face which is co-operable with a complementary face formed on a part of said extension portion which projects substantially beyond the pivotal connection in the direction towards said actuator means, whereby sliding movement of said wedge member effects tilting of the extension portion with respect to said main portion.

Preferably said main portion of the canopy is provided with a stop against which a surface of said projecting part of said extension portion engages when that portion is in a position generally in alignment with said main portion of the canopy.

Preferably also said actuator means comprises an hydraulically-operable telescopic jack, the piston rod of which is pivotally-connected to, or engages, said wedge member.

The said main portion of the canopy may be of hollow form or alternatively of inverted channel-shaped cross-section and in this case the actuator means and said wedge member are suitably housed within the interior thereof with their longitudinal axes parallel, or substantially so, to the longitudinal axis of said main portion.

The advantages offered by the invention are mainly that tilting of the extension portion with respect to the main portion of the canopy can be effected in a compact manner, and the actuator means can be horizontally-disposed, without the need for any pivotal driving linkage otherwise projecting into the space immediately beneath the canopy.

Figure 2:
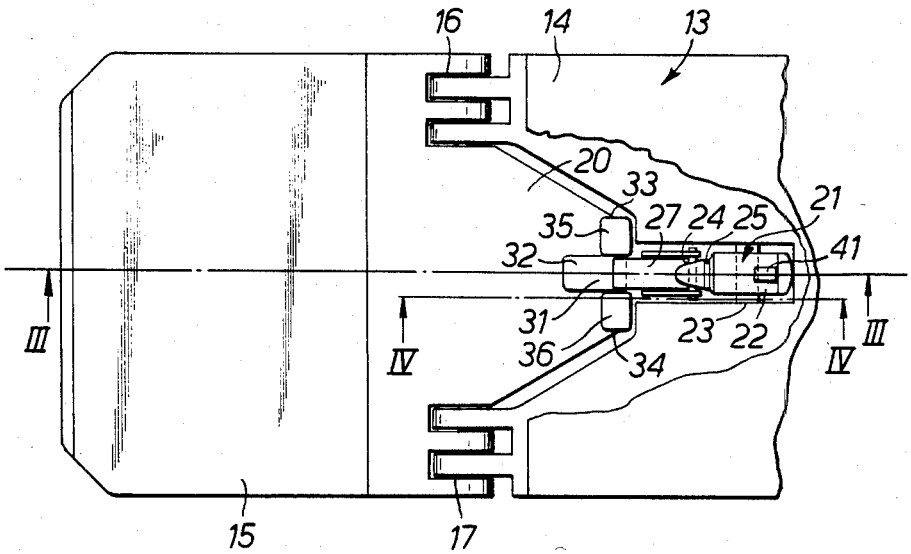
Figure 3:
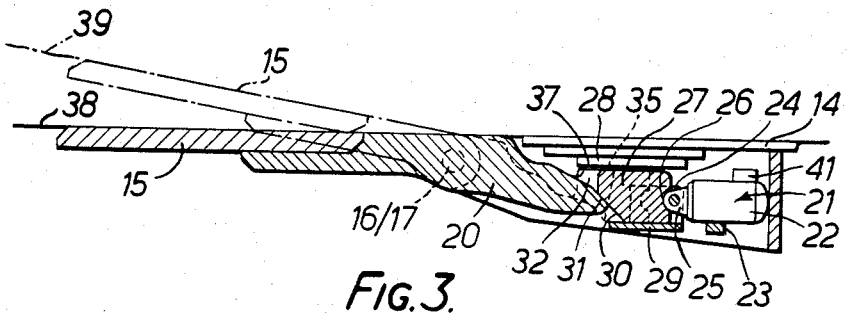
Figure 4:
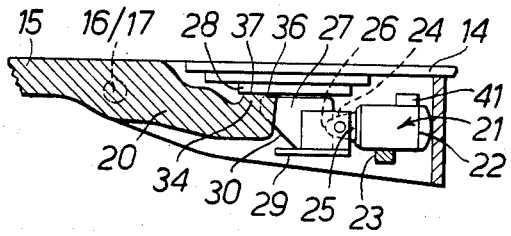
Figure 5:
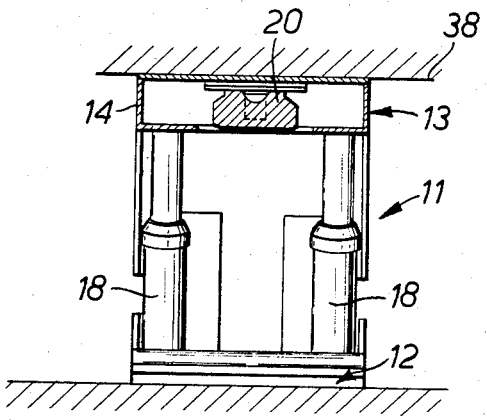

One way of carrying out the invention is described in detail below with reference to drawings which illustrate only one specific embodiment, in which FIG. 1 is a side elevation of a roof support in accordance with the invention, FIG. 2 is an enlarged, partly cut-away, plan view of part of the roof support shown in FIG. 1, FIG. 3 is a cross-section taken along the line III—III in FIG. 2, FIG. 4 is a cross-section taken along the line IV—IV in FIG. 2, and FIG. 5 is a cross-section taken along the line V—V in FIG. 1.

In the drawings a roof support 11 for use in a mine for supporting the mine roof during mineral-mining operations comprises a mine floor-engaging structure in the form of a floor beam 12, a roof-engageable canopy 13 comprising a main portion 14 of inverted channel-shaped cross-section and an extension portion 15 suitably hinged thereto as shown at 16, 17, and prop means. The prop means comprise a pair of hydraulically extendible and contractible props 18 which are carried by the beam 12 and which support the portion 14 at its forward part and a pair of similar props 19 which are also carried by the beam 12 and which support the portion 14 at its rearward part.

A part 20 of the extension portion 15 projects rearwardly, that is to the right in FIGS. 1 to 4, substantially beyond the hinges 16, 17 in the direction towards actuator means, in the form of a fluid-pressure-operable telescopic jack 21, which is mounted within the cross-sectional profile of main portion 14. The cylinder 22 of the jack is carried upon a transverse member 23 and the free end portion 24 of its piston rod 25, which is of part-spherical shape, engages a seating 26 of complementary shape formed in a wedge member 27. The longitudinal axes of the wedge member and jack are parallel to the longitudinal axis of the portion 14. Member 27 is carried by and slidable in slides 28, 29, its forward end face 30 being steeply-inclined in the manner more clearly shown in FIGS. 3 and 4. Face 30 is in sliding engagement with a similar steeply-inclined face 31 on the rearward extremity of the extension portion 15, this face being formed by the base of a suitably-slotted part 32 thereof. Flanking the face 31 are two upstanding projections 33, 34 having flat upper surfaces 35, 36 which are engageable with respective abutments, one of which is shown at 37, which are provided adjacent the forward end portion of the slide 28 on the underside of portion 14. When the canopy 13 is raised by the props 18, 19 against a relatively flat and even mine roof surface 38, the jack 21 is maintainted in its contracted condition so that the extension portion 15 remains generally in line with the main portion 14 of the canopy as shown in full lines in FIG. 3. In this position of portion 15 the surfaces 35, 36 are in firm engagement with the abutments 37 so that portion 15 is fully load-bearing.

If the canopy is raised against a roof surface 39 where cavities and/or divergence in the mine roof exist adjacent the working face 40 of the mine, it is necessary for the portion 15 to be moved into load-supporting engagement with the cavities and/or divergent roof surface. Accordingly the jack 21 is extended causing the wedge member 27 to move forwardly in its slides 28, 29. The steeply-inclined face 30 thus cooperates with steeply-inclined face 31 to cause the portion 15 to tilt upwardly about the hinges 16, 17, the surfaces 35, 36 thus moving away from the abutments 37. Hydraulic liquid under pressure applied to the jack 21 for such tilting operation is maintained in the jack to hold the portion 15 in load-supporting engagement with the roof. However, if the roof loading on portion 15 becomes excessive that portion can yield, tilting downwardly about is hinges 16, 17. Such movement, which is applied to jack 21 through the intermediary of wedge member 27, is pemitted by yield valve means 41 associated with the jack. If the roof forces are very high the portion 15 can, in yielding, tilt as far downwardly as its position in which it is generally in line with respect to the main portion 14 so that the surfaces 35, 36 engage the abutments 37.

Upon such engagement of these surfaces with the abutments, yielding movement of the portion 15 is resisted and loading upon that portion is then taken on the abutments.

Thus in the embodiment above described the extension portion 15 is capable of being set against the roof by wedging, followed by wedge yielding until the extension portion becomes fully load-bearing in the horizontal, or substantially horizontal, position. The wedge angle at the cooperable faces 30, 31 is, as shown in the drawings, relatively steep, this compared with the angle of friction, and the stop formed by the cooperating surfaces 35, 36 and abutments 37 when the extension portion moves back to its in-line position with the main portion is fully load-bearing.

If, however, in another embodiment of the invention the wedge angle is arranged to be sufficiently shallow it is possible for wedge setting of the extension portion 15 to be obtained with full yield bearing capability at any point within the upward articulation of the extension portion without the need for yield valve means in association with the jack 21. Under highly-loaded conditions of the extension portion, on yielding movement the shallow wedging angle permits the cooperable wedging faces to lock-up so that the main portion of the canopy and the extension portion then become as one and any further yielding is afforded by the props of the support. Such locking-up will occur with no, or substantially no, compression of the jack and thus the jack takes virtually no part in the yielding function. In this case the loadbearing members of the roof suport must have adequate strength to carry full yield load from the props of the support.

The invention is not limited to the form of wedge member and the form of its slide mounting as above described with reference to the accompanying drawings as in other embodiments of the invention and with advantage the wedge member may be of other suitable form and the means for its slide mounting may also be of other suitable form, for example incorporating anti-friction rollers or balls or suitable anti-friction inserts.

Although in the embodiment above described with reference to the drawings the actuator means for effecting wedging and thus tilting of the extension portion of the canopy comprises a fluid-pressure-operable telescopic jack 21, in other embodiments of the invention the actuator means may be of other type suitable for housing within, or substantially within, the cross-sectional profile of the main portion of the canopy.

I claim:

1. A roof support, suitable for use in mines, including a floor-engaging structure, extendible and contractible prop means carried by said structure, a roof-engageable canopy, supported by said prop means, which comprises a main portion and an extension portion pivotally-connected to the main portion, actuator means carried by said main portion, and a wedge member so carried by said main portion and so connected with the output member of said actuator means as to be slidable, upon operation of said actuator means, lengthwise of said main portion, the end portion of said wedge member remote from said actuator means having a wedging face which is co-operable with a complementary face formed on a part of said extension portion which projects substantially beyond the pivotal connection in the direction towards said actuator means, whereby sliding movement of said wedge member effects tilting of the extension portion with respect to said main portion.

2. A support as claimed in claim 1, wherein said main portion of the canopy is provided with a stop against which a surface of said projecting part of said extension portion engages when that portion is in a position generally in alignment with said main portion of the canopy.

3. A support as claimed in claim 1, wherein said actuator means comprises an hydraulically-operable telescopic jack, the piston rod of which engages said wedge member.

4. A support as claimed in claim 1, wherein said main portion of said canopy is of inverted channel-shaped cross-section.

5. A support as claimed in claim 4, wherein said actuator means and said wedge member are suitably housed within the interior of said canopy and are disposed in parallel manner with respect to the longitudinal axis of said main portion.

6. A support as claimed in claim 5, wherein said wedge member is carried in slides housed within the interior of said canopy.

7. A support as claimed in claim 1, wherein said wedging face of said wedge member is steeply-inclined and said complementary face on said extension portion is similarly steeply-inclined.

8. A support as claimed in claim 7, wherein said complementary face is formed by the base of a suitably-slotted part of said extension portion.

9. A support as claimed in claim 8, wherein two upstanding projections flank said complementary face, said projections having flat upper surfaces which are each engageable with a respective stop which is provided on the underside of said main portion of said canopy.

* * * * *